US009246253B1

(12) United States Patent
Defibaugh et al.

(10) Patent No.: US 9,246,253 B1
(45) Date of Patent: Jan. 26, 2016

(54) CONNECTOR WITH STABILIZATION MEMBERS AND METHOD OF ASSEMBLY

(71) Applicant: TYCO ELECTRONICS CORPORATION, Berwyn, PA (US)

(72) Inventors: George Richard Defibaugh, Harrisburg, PA (US); Fieldon Nathan Daubert, Annville, PA (US); John Philip Lantzy, II, Oak Ridge, NC (US); Joseph Richard Olson, Palmyra, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/555,033

(22) Filed: Nov. 26, 2014

(51) Int. Cl.
*H01R 12/00* (2006.01)
*H01R 12/71* (2011.01)
*H01R 12/52* (2011.01)

(52) U.S. Cl.
CPC ..... *H01R 12/716* (2013.01); *H01R 12/523* (2013.01)

(58) Field of Classification Search
CPC ..... H01R 12/523
USPC ..... 439/82, 84, 301, 377, 943
See application file for complete search history.

(56) References Cited

U.S. PATENT DOCUMENTS

| | | | | | |
|---|---|---|---|---|---|
| 3,403,369 | A * | 9/1968 | Steiff | H01R 12/727 | 439/560 |
| 3,564,479 | A * | 2/1971 | Gluntz | H01R 12/7088 | 439/109 |
| 4,652,975 | A * | 3/1987 | Scott | H01F 27/06 | 336/65 |
| 4,952,529 | A * | 8/1990 | Grider | H05K 3/3405 | 29/836 |
| 5,059,130 | A * | 10/1991 | Miller, Jr. | H01R 12/523 | 439/74 |
| 8,480,412 | B2 * | 7/2013 | Belanger, Jr. | H01R 12/7064 | 439/751 |
| 2011/0039428 | A1 * | 2/2011 | Ludwig | H01R 12/585 | 439/82 |

* cited by examiner

*Primary Examiner* — Tho D Ta

(57) ABSTRACT

An embodiment is directed to a method and a connector for mounting on a substrate. Terminal receiving recesses extend through a bottom wall of the connector. Contacts are positioned in the terminal receiving recesses. The contacts have securing sections for securing the contacts in the terminal receiving recesses and substrate mating sections which extend from the bottom wall of the housing in a direction away from the top wall. At least one stabilization member extends from the bottom wall of the housing in a direction away from the top wall. The at least one stabilization member is movable between a first position and a second position. The at least one stabilization member engages the substrate when the at least one stabilization member is in the first position to maintain the connector in a stable position relative to the substrate.

18 Claims, 4 Drawing Sheets

CONNECTOR WITH STABILIZATION MEMBERS AND METHOD OF ASSEMBLY

FIELD OF THE INVENTION

The present invention is directed to a connector with stabilization members and a method of assembly to support the connector on a substrate prior to termination of the connector to the substrate. In particular, the invention is directed to a connector with stabilization members which are movable as the connector is terminated to the substrate.

BACKGROUND OF THE INVENTION

Connector assemblies for use with substrates, including printed circuit boards are known in the industry. The connector assembly customarily includes a plurality of contacts arranged in some manner such that upon mating to the printed circuit board electrical continuity is effectively established between the connector contacts and conducting paths or strips defined in the board. Usually, these contacts are spring loaded or otherwise resiliently pressed against the printed circuit board so that an appropriate contact force is developed to hold the board and connector together as a composite unit. Further, the force developed must be of such magnitude to insure that a sufficient low resistance connection is established and maintained between the printed circuit board conductive strips or paths and the resilient contacts of the connector itself.

However, prior to the connector being fully inserted into the substrate, the connector must be properly positioned in alignment with the openings of the substrate and maintained in position until sufficient force is provided to fully insert the connector on the substrate. Therefore, in order to prevent bending of the contact or other failures of the connector, the connector, with the contacts protruding there from, must be able to be properly positioned and maintained in position prior to insertion.

It would, therefore, be beneficial to provide an electrical connector which can be positioned on a substrate and be maintained in proper and stable position prior to the contacts being fully inserted into the openings of the substrate, even in instances in which only one row of contacts are provided. It would also be beneficial to provide a connector which has stabilization members which can move between a first position in which the stabilization members cooperate with a substrate to maintain the stability of the connector relative to the substrate and a second position in which the stabilization members allow the insertion of the connector onto the substrate.

SUMMARY OF THE INVENTION

An embodiment is directed to a connector for mounting on a substrate. The connector includes a housing having a top wall, a bottom wall, side walls extending between the top wall and the bottom wall, and end walls extending between the side walls. Terminal receiving recesses extend through the bottom wall. Contacts are positioned in the terminal receiving recesses. The contacts have securing sections for securing the contacts in the terminal receiving recesses and substrate mating sections which extend from the bottom wall of the housing in a direction away from the top wall. At least one stabilization member extends from the bottom wall of the housing in a direction away from the top wall. The at least one stabilization member is movable between a first position and a second position. The at least one stabilization member engages the substrate when the at least one stabilization member is in the first position to maintain the connector in a stable position relative to the substrate.

An embodiment is directed to a connector for mounting on a substrate. The connector includes a housing having a top wall, a bottom wall, side walls extending between the top wall and the bottom wall, and end walls extending between the side walls. Terminal receiving recesses extend through the bottom wall. Contacts are positioned in the terminal receiving recesses. The contacts have securing sections for securing the contacts in the terminal receiving recesses and substrate mating sections which extend from the bottom wall of the housing in a direction away from the top wall. At least one stabilization member extends from the bottom wall of the housing in a direction away from the top wall. The at least one stabilization member is movable between a first position and a second position. The at least one stabilization member engages the substrate when the at least one stabilization member is in the first position to maintain the connector in a stable position relative to the substrate. The at least one stabilization member is connected to the housing of the connector by portions which are configured to be weak, wherein when a force is applied to the at least one stabilization member in a direction toward the top wall, the weak portions will fail, allowing the at least one stabilization member to move toward the second position.

An embodiment is directed to a method of inserting a connector onto a substrate. The method includes aligning mating ends of terminals of a connector with openings in the substrate, positioning connector on the substrate in a first position wherein the tips of the mating ends of the connector are positioned in the openings and at least one bottom wall of at least one stabilization member is in engagement with the substrate, maintaining the connector in the first position by the cooperation of at least one bottom wall of at least one stabilization member with the substrate, exerting a force on the housing of the connector to move the housing toward the substrate and moving the at least one stabilization member from a first position in which the at least one stabilization member extends from a bottom wall of the connector to a second position in which the at least one stabilization member is retained in a slot with the housing of the connector.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
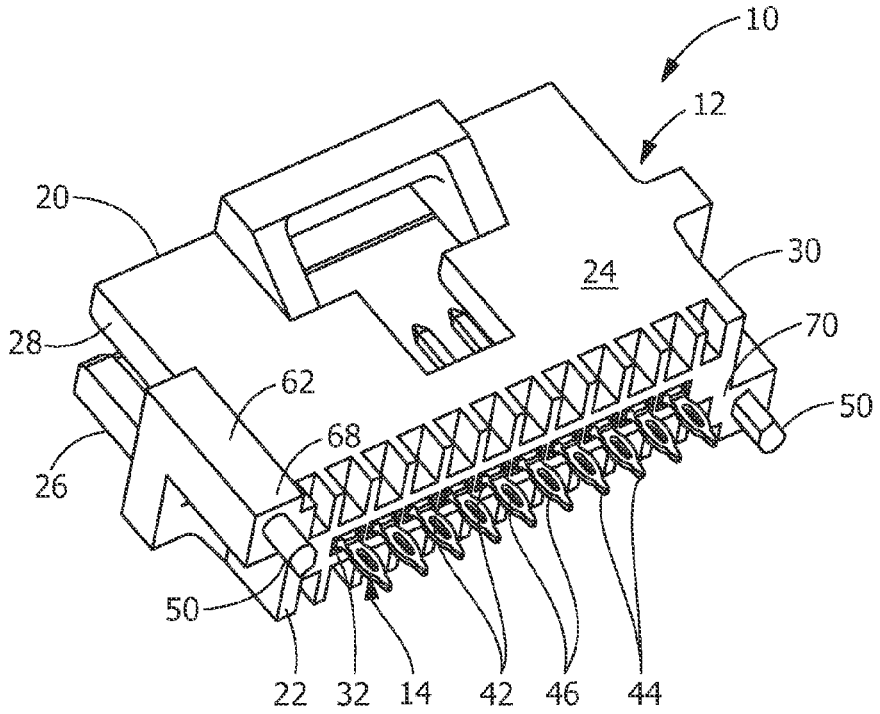
FIG. 1 is a bottom perspective view of a first illustrative embodiment of a connector with movable stabilization members according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 2:
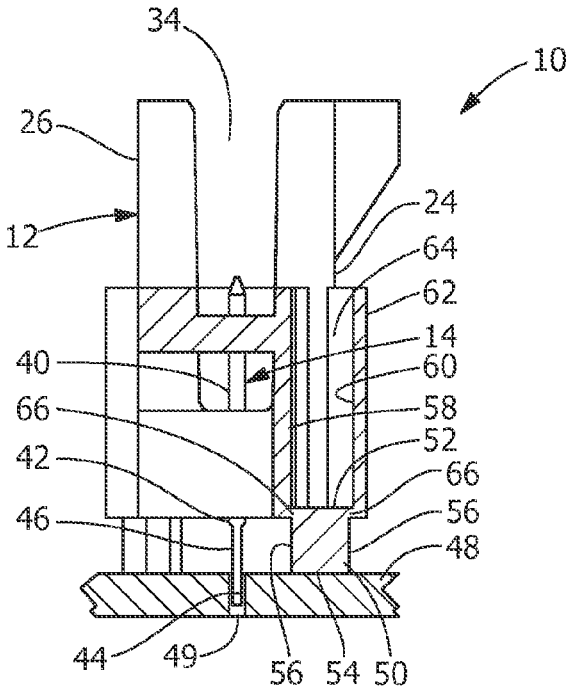
FIG. 2 is an enlarged cross-sectional view of one of the stabilization members of FIG. 1 shown positioned in a first position relative to a substrate.
Figure 3:
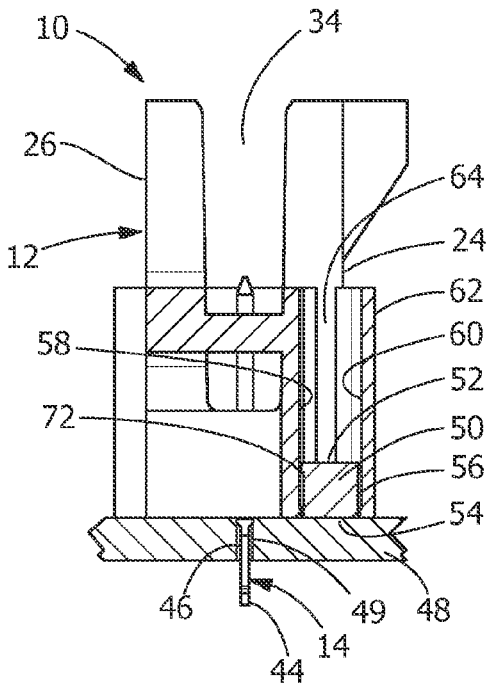
FIG. 3 is an enlarged cross-sectional view of the stabilization member of FIG. 2 shown positioned in a second position relative to the substrate.

Referring now to FIGS. 1 through 3, a shrouded vertical header connector 10 includes a dielectric housing 12, made of thermoplastic material or other suitable material and a plurality of conductor pins or terminals 14. Terminals 14 may be made from any suitable conductive materials which have the appropriate electrical and mechanical properties required.

The housing 12 has top surface 20, a bottom wall 22, side walls 24, 26 which extend between the top surface 20 and the bottom wall 22 and end walls 28, 30 which extend between the side walls 24, 26.

In the embodiment shown, the housing 12 has one row of longitudinal terminal receiving recesses 32 which extend through the bottom wall 22 of the housing 12 toward the top surface 20. In the illustrative embodiment shown, the top surface 20 of the housing 12 has a mating cavity 34 which extends from the top surface 20 toward the bottom wall 22. The mating cavity 34 is dimensioned to receive an appropriate mating connector therein. However, various numbers of rows and other configurations of the terminal receiving recesses 32 can be used without departing from the scope of the invention.

The housing 12 shown in FIGS. 1 through 3 is shown for illustrative purposes only. Many different housings can be used without departing from the scope of the invention. In addition, the connector 10 may be oriented horizontally or vertically, as known in the industry.

As best shown in FIG. 1, mating portions 40 of the terminals 14 are positioned in the mating cavity 34. In the illustrative embodiment shown, mating portions 40 are round and have tapered or pointed ends. However, other types of mating portions 40 can be used without departing from the scope of the invention. Each terminal 14 has a connector securing section 42 provided proximate the mating portion 40. The connector securing sections 42 maintain the terminals 14 in the terminal receiving recesses 32 of the housing 12. The connector securing sections 42 can be of any type known in the industry, including, but not limited to, projections or barbs.

Substrate mating ends 44 of the terminals 14 extend from the connector securing sections 42 and from the housing 12. The mating ends 44 have substrate mating sections or portions 46, which may have, but are not limited to, compliant sections or barbs. The mating ends 44 are dimensioned to cooperate with openings 49 of a mating substrate 48. The opening 49 may be, but not limited to, through holes.

The substrate 48 has a predetermined pattern of openings 49 which receive the substrate mating portions 46 when the connector is fully mated to the substrate 48. The substrate 48 may be, but is not limited to, a printed circuit board which has conductors or circuit paths.

Stabilization members 50 are provide proximate the bottom wall 22 of the housing 12. As best viewed in FIGS. 2 and 3, the stabilization members 50 have a stabilization member top wall 52, a stabilization member bottom wall 54, stabilization member side walls 56 which extend between the stabilization member top wall 52 and the stabilization member bottom wall 54. In the initial or first position, as shown in FIG. 2, the respective sidewalls 56 of each stabilization member 50 are integrally molded to walls 58, 60 of a respective mounting member 62 which extends from a side wall 24 and an end wall 28 to form a weak portion or area 66. The walls 58, 60 define a stabilization members receiving slot 64. In this initial position, the stabilization members 50 extend from the bottom wall 22 a distance which is less than the distance that the mating ends 44 of the terminals 14 extend from the bottom wall 22.

The areas or portions 66 provided between the walls 58, 60 and the side walls 56 are configured to be thin and/or weak. Consequently, an upward force (in a direction to the top surface 20) applied to the stabilization members 50 causes the weak portions 66 to fail or breakaway from the walls 58, 60 and/or the side walls 56. Once the weak portions 66 have failed, the continued application of the force causes the stabilization members 50 to move in the slots 64 from the first position shown in FIG. 2 to the second position shown in FIG. 3.

While the weak portions 66 are shown as integrally molded members, the portions 66 may be dimples or other members which are positioned either on the stabilization member 50 or the walls 58, 60. In such embodiments, the members provide a frictional or interference fit between the stabilization member 50 and the walls 58, 60 to retain the stabilization member 50 in the first position.

In use, the connector 10 is positioned on the substrate 48 in an initial position (FIG. 2). In this position, the tips of the mating ends 44 of the terminals 14 are positioned in the openings 49 of the substrate 48. However, the mating ends 44 are not fully seated or fully inserted into the openings 49. Consequently, without additional support, the connector 10 would not be stable on the substrate 48 as the assembly process continues. The stabilization members 50 are provided to cooperate with the substrate 48 to stabilize the connector 10 thereon. In the first position, the bottom walls 54 of the stabilization members 50 engage the substrate 48 to stabilize or balance the connector 10 on the substrate. The stabilization members 50 are provided on opposite corners 68, 70 of the connector 10 such that the stabilization members 50 are provided on opposite sides of the terminals 14 to provide proper support. As the stabilization members 50 are integrally molded to the housing 12, the stabilization members 50 remain in the first position until a force is applied thereto.

At the appropriate time, a force is applied to the housing 12 of the connector 10 to cause the bottom wall 22 of the housing 12 to move toward the substrate 48. As this occurs, the substrate 48 cause an upward force to be applied to the stabilization members 50, causing the weak portions 66 to fail or breakaway from the stabilization members 50. Once the weak portions 66 has failed, the continued application of the force causes the stabilization members 50 to move in the slots 64, moving the stabilization members 50 from the first position shown in FIG. 2 to the second position shown in FIG. 3.

The force applied to the housing 12 is stopped when the mating portions 46, of mating ends 44 are fully seated in the openings 49 of the substrate 48. In this position, the stabilization members 50 are retained in the slots 64.

Figure 4:
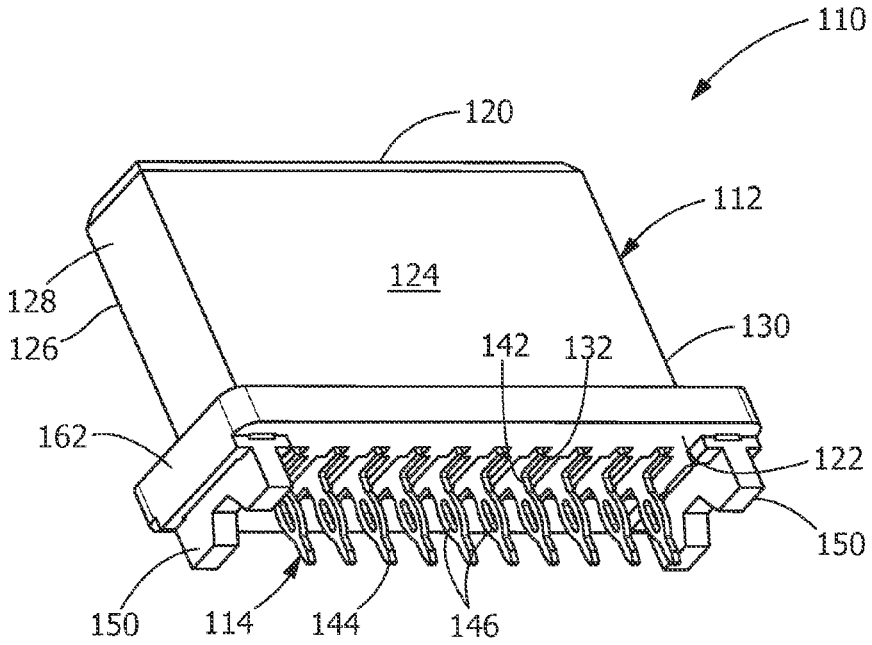
FIG. 4 is a bottom perspective view of a second illustrative embodiment of a connector with movable stabilization members according to the present invention.
Figure 5:
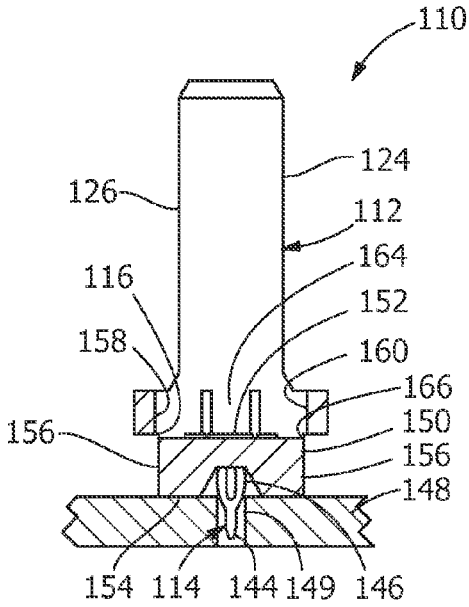
FIG. 5 is an enlarged cross-sectional view of one of the stabilization members of FIG. 4 shown positioned in a first position relative to a substrate.
Figure 6:
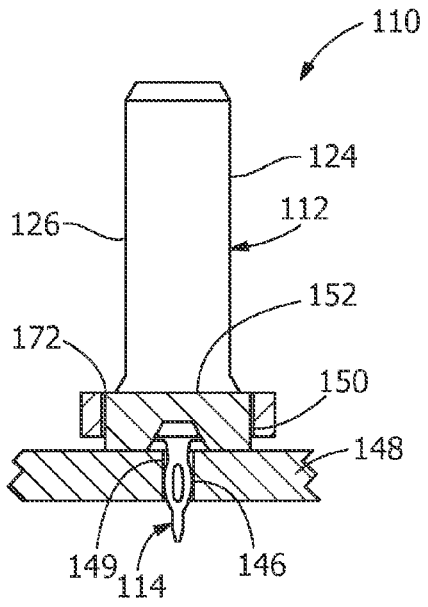
FIG. 6 is an enlarged cross-sectional view of the stabilization member of FIG. 5 shown positioned in a second position relative to the substrate.

Referring now to FIGS. 4 through 6, a vertical mating connector 110 includes a dielectric housing 112, made of thermoplastic material or other suitable material and a plurality of conductor pins or terminals 114. Terminals 114 may be made from any suitable conductive materials which have the appropriate electrical and mechanical properties required.

The housing 112 has top surface 120, a bottom wall 122, side walls 124, 126 which extend between the top surface 120 and the bottom wall 122 and end walls 128, 130 which extend between the side walls 124, 126.

In the embodiment shown, the housing 112 has one row of longitudinal terminal receiving recesses 132 which extend through the bottom wall 122 of the housing 112 toward the top surface 120. However, various numbers of rows and other configurations of the terminal receiving recesses 132 can be used without departing from the scope of the invention.

The housing 112 shown in FIGS. 4 through 6 is shown for illustrative purposes only. Many different housings can be used without departing from the scope of the invention. In addition, the connector 110 may be oriented horizontally or vertically, as known in the industry.

As best shown in FIG. 4, each terminal 114 has a connector securing section 142 provided to maintain the terminals 114 in the terminal receiving recesses 132 of the housing 112. The connector securing sections 142 can be of any type known in the industry, including, but not limited to, projections or barbs.

Substrate mating ends 144 of the terminals 114 extend from the connector securing sections 142 and from the housing 112. The mating ends 144 have substrate mating sections or portions 146, which may have, but are not limited to, compliant sections or barbs. The mating ends 144 are dimensioned to cooperate with openings 149 of a mating substrate 148. The opening 149 may be, but not limited to, through holes.

The substrate 148 has a predetermined pattern of openings 149 which receive the substrate mating portions 146 when the connector is fully mated to the substrate 148. The substrate 148 may be, but is not limited to, a printed circuit board which has conductors or circuit paths.

Stabilization members 150 are provide proximate the bottom wall 122 of the housing 112. As best viewed in FIGS. 5 and 6, the stabilization members 150 have a top wall 152, a bottom wall 154, side walls 156 which extend between the top wall 152 and the bottom wall 154. In the initial or first position, as shown in FIG. 5, the respective sidewalls 156 of each stabilization member 150 are integrally molded to walls 158, 160 of a respective mounting member 162 to form a weak portion or area 166. The walls 158, 160 define a stabilization members receiving slot 164. In this initial position, the stabilization members 150 extend from the bottom wall 122 a distance which is less than the distance that the mating ends 144 of the terminals 114 extend from the bottom wall 122.

The areas or portions 166 provided between the walls 158, 160 and the side walls 156 are configured to be thin and/or weak. Consequently, an upward force (in a direction to the top surface 120) applied to the stabilization members 150 causes the weak portions 166 to fail or breakaway from the walls 158, 160 and/or the side walls 156. Once the weak portions 166 have failed, the continued application of the force causes the stabilization members 150 to move in the slots 164 from the first position shown in FIG. 5 to the second position shown in FIG. 6.

While the weak portions 166 are shown as integrally molded members, the portions 166 may be dimples or other members which are positioned either on the stabilization member 150 or the walls 158, 160. In such embodiments, the members provide a frictional or interference fit between the stabilization member 150 and the walls 158, 160 to retain the stabilization member 150 in the first position.

In use, the connector 110 is positioned on the substrate 148 in an initial position (FIG. 5). In this position, the tips of the mating ends 144 of the terminals 114 are positioned in the openings 149 of the substrate 148. However, the mating ends 144 are not fully seated or fully inserted into the openings 149. Consequently, without additional support, the connector 110 would not be stable on the substrate 148 as the assembly process continues. The stabilization members 150 are provided to cooperate with the substrate 148 to stabilize the connector 110 thereon. In the first position, the bottom walls 154 of the stabilization members 150 engage the substrate 148 to stabilize or balance the connector 110 on the substrate. The stabilization members 150 are provided on opposite ends 128, 130 of the connector 110. The stabilization members 150 extend so that portions of the stabilization members 150 are provided on opposite sides of the terminals 114 to provide proper support. As the stabilization members 150 are integrally molded to the housing 112, the stabilization members 150 remain in the first position until a force is applied thereto.

At the appropriate time, a force is applied to the housing 112 of the connector 110 to cause the bottom wall 122 of the housing 112 to move toward the substrate 148. As this occurs, the substrate 148 cause an upward force to be applied to the stabilization members 150, causing the weak portions 166 to fail or breakaway from the stabilization members 150. Once the weak portions 166 have failed, the continued application of the force causes the stabilization members 150 to move in the slots 164, moving the stabilization members 150 from the first position shown in FIG. 5 to the second position shown in FIG. 6.

The force applied to the housing 112 is stopped when the mating portions 146, of mating ends 144 are fully seated in the openings 149 of the substrate 148. In this position, the stabilization members 150 are retained in the slots 164.

Figure 7:
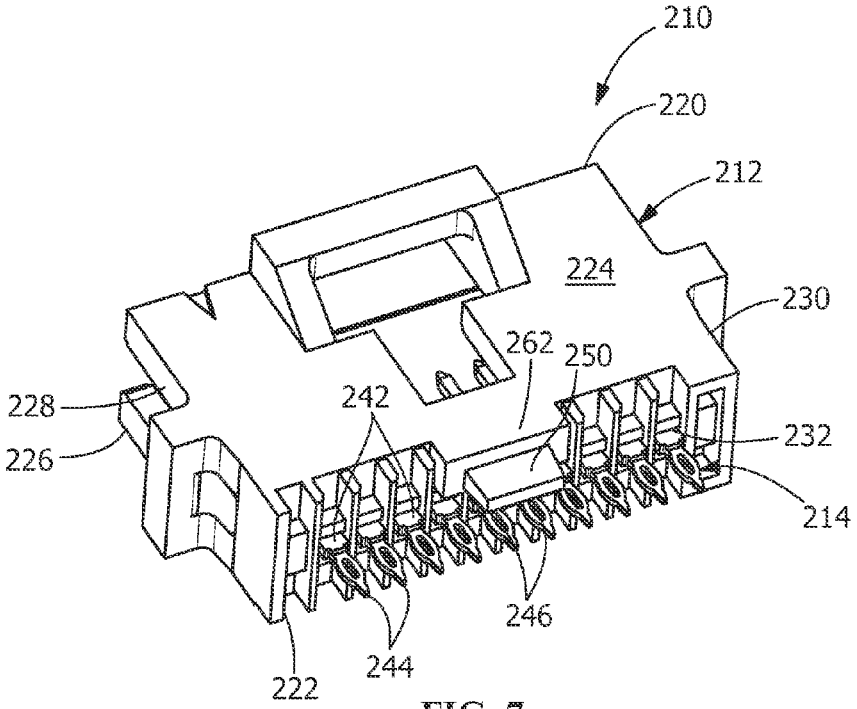
FIG. 7 is a bottom perspective view of a third illustrative embodiment of a connector with a movable stabilization member according to the present invention.
Figure 8:
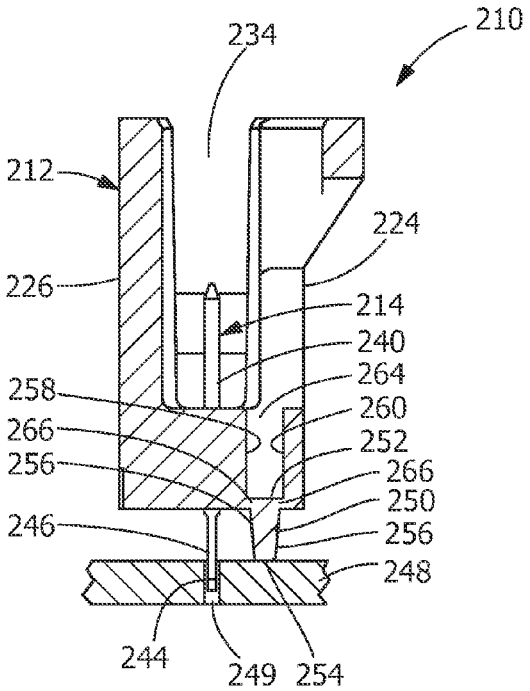
FIG. 8 is an enlarged cross-sectional view of the stabilization member of FIG. 7 shown positioned in a first position relative to a substrate.
Figure 9:
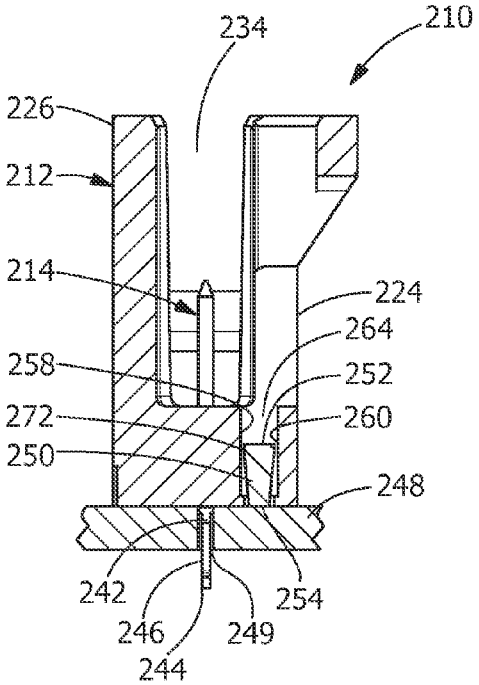
FIG. 9 is an enlarged cross-sectional view of the stabilization member of FIG. 8 shown positioned in a second position relative to the substrate.

Referring now to FIGS. 7 through 9, a shrouded vertical header connector 210 includes a dielectric housing 212, made of thermoplastic material or other suitable material, and a plurality of conductor pins or terminals 214. Terminals 214 may be made from any suitable conductive materials which have the appropriate electrical and mechanical properties required.

The housing 212 has top surface 220, a bottom wall 222, side walls 224, 226 which extend between the top surface 220 and the bottom wall 222 and end walls 228, 230 which extend between the side walls 224, 226.

In the embodiment shown, the housing 212 has one row of longitudinal terminal receiving recesses 232 which extend through the bottom wall 222 of the housing 212 toward the top surface 220. In the illustrative embodiment shown, the top surface 220 of the housing 212 has a mating cavity 234 which extends from the top surface 220 toward the bottom wall 222. The mating cavity 234 is dimensioned to receive an appropriate mating connector therein. However, various numbers of rows and other configurations of the terminal receiving recesses 232 can be used without departing from the scope of the invention.

The housing 212 shown in FIGS. 7 through 9 is shown for illustrative purposes only. Many different housings can be used without departing from the scope of the invention. In addition, the connector 210 may be oriented horizontally or vertically, as known in the industry.

As best shown in FIG. 7, mating portions 240 of the terminals 214 are positioned in the mating cavity 234. In the illustrative embodiment shown, mating portions 240 are round and have tapered or pointed ends. However, other types of mating portions 240 can be used without departing from the scope of the invention. Each terminal 214 has a connector securing section 242 provided proximate the mating portion 240. The connector securing sections 242 maintain the terminals 214 in the terminal receiving recesses 232 of the housing 212. The connector securing sections 242 can be of any type known in the industry, including, but not limited to, projections or barbs.

Substrate mating ends 244 of the terminals 214 extend from the connector securing sections 242 and from the housing 212. The mating ends 244 have substrate mating sections or portions 246, which may have, but are not limited to, compliant sections or barbs. The mating ends 244 are dimensioned to cooperate with openings 249 of a mating substrate 248. The opening 249 may be, but not limited to, through holes.

The substrate 248 has a predetermined pattern of openings 249 which receive the substrate mating portions 246 when the connector is fully mated to the substrate 248. The substrate 248 may be, but is not limited to, a printed circuit board which has conductors or circuit paths.

A stabilization member 250 is provide proximate the bottom wall 222 of the housing 212. As best viewed in FIGS. 8 and 9, the stabilization member 250 has a top wall 252, a bottom wall 254 and side walls 256 which extend between the top wall 252 and the bottom wall 254. In the initial or first position, as shown in FIG. 8, the respective sidewalls 256 of the stabilization member 250 are integrally molded to walls 258, 260 of a respective mounting member 262 to form a weak portion or area 266. The walls 258, 260 define a stabilization member receiving slot 264. In this initial position, the stabilization member 250 extends from the bottom wall 222 a distance which is less than the distance that the mating ends 244 of the terminals 214 extend from the bottom wall 222.

The areas or portions 266 provided between the walls 258, 260 and the side walls 256 are configured to be thin and/or weak. Consequently, an upward force (in a direction to the top surface 220) applied to the stabilization member 250 causes the weak portions 266 to fail or breakaway from the walls 258, 260 and/or the side walls 256. Once the weak portions 266 have failed, the continued application of the force causes the stabilization member 250 to move in the slot 264 from the first position shown in FIG. 8 to the second position shown in FIG. 9.

While the weak portions 266 are shown as integrally molded members, the portions 266 may be dimples or other members which are positioned either on the stabilization member 250 or the walls 258, 260. In such embodiments, the members provide a frictional or interference fit between the stabilization member 250 and the walls 258, 260 to retain the stabilization member 250 in the first position.

In use, the connector 210 is positioned on the substrate 248 in an initial position (FIG. 8). In this position, the tips of the mating ends 244 of the terminals 214 are positioned in the openings 249 of the substrate 248. However, the mating ends 244 are not fully seated or fully inserted into the openings 249. Consequently, without additional support, the connector 210 would not be stable on the substrate 248 as the assembly process continues. The stabilization members 250 are provided to cooperate with the substrate 248 to stabilize the connector 210 thereon. In the first position, the bottom walls 254 of the stabilization members 250 engage the substrate 248 to stabilize or balance the connector 210 on the substrate. In the embodiment shown in FIG. 8, the stabilization member 250 is provided proximate the center of the connector 210. As the stabilization member 250 is integrally molded to the housing 212, the stabilization member 250 remains in the first position until a force is applied thereto.

At the appropriate time, a force is applied to the housing 212 of the connector 210 to cause the bottom wall 222 of the housing 212 to move toward the substrate 248. As this occurs, the substrate 248 causes an upward force to be applied to the stabilization member 250, causing the weak portions 266 to fail or breakaway from the stabilization member 250. Once the weak portions 266 have failed, the continued application of the force causes the stabilization member 250 to move in the slot 264, moving the stabilization member 250 from the first position shown in FIG. 8 to the second position shown in FIG. 9.

The force applied to the housing 212 is stopped when the mating portions 246 of mating ends 244 are fully seated in the openings 249 of the substrate 248. In this position, the stabilization member 250 is retained in the slot 264.

In any of the embodiments described above, if the connector 10, 110, 210 is removed from the substrate 48, 148, 248, the stabilization members 50, 150, 250 are configured to be retained in the slots 64, 164, 264. The top walls 52, 152, 252 of the stabilization members 50, 150, 250 may have flanges 72, 172, 272 which prevent the stabilization members 50, 150, 250 from being fully removed from the slots 64, 164, 264. Other alternative methods of retaining the stabilization members 50, 150, 250 in the slots 64, 164, 264 may be used.

Figure 10:
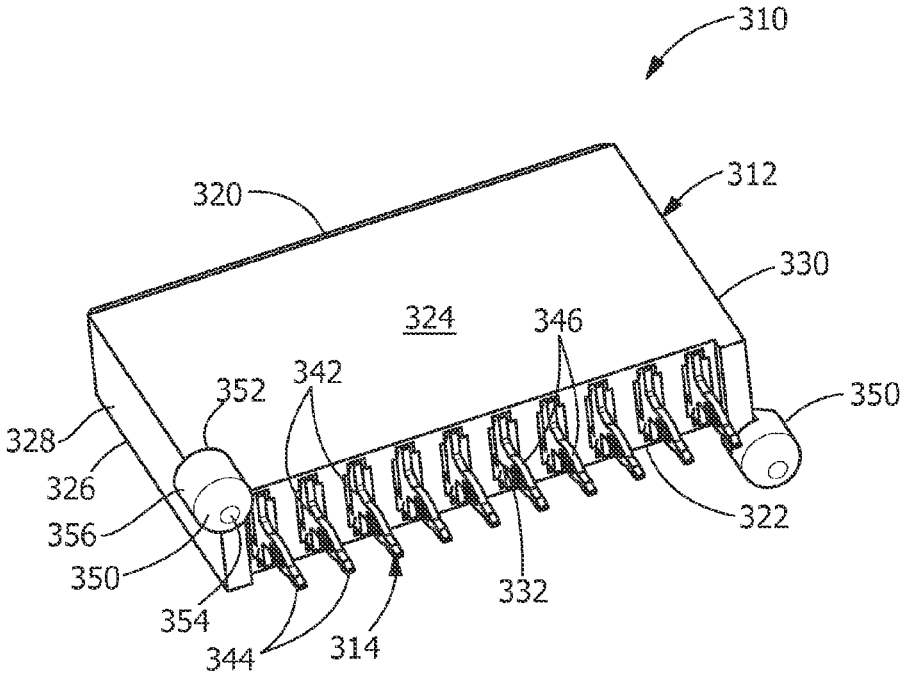
FIG. 10 is a bottom perspective view of a fourth illustrative embodiment of a connector with movable stabilization members according to the present invention.
Figure 11:
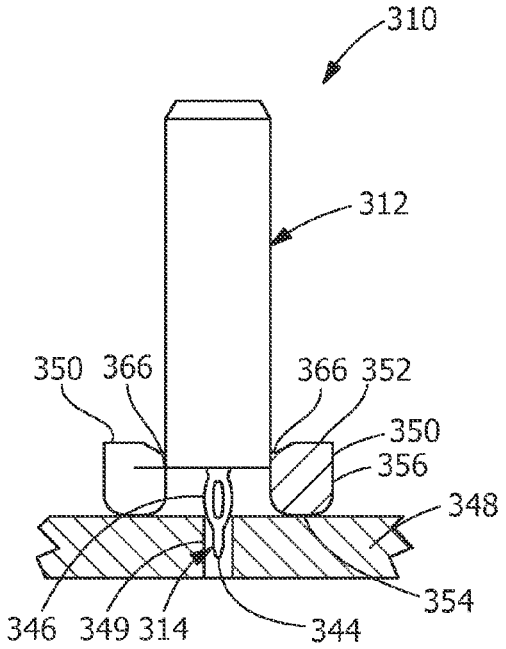
FIG. 11 is an enlarged cross-sectional view of the connector and one of the stabilization members of FIG. 10 shown positioned in a first position relative to a substrate.
Figure 12:
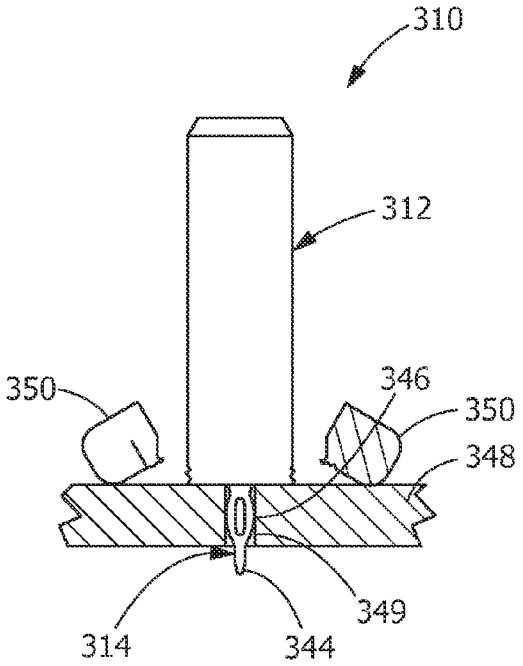
FIG. 12 is an enlarged cross-sectional view of the connector of FIG. 11 shown positioned in a second position relative to the substrate with the stabilization member disengaged from the connector.

Referring now to FIGS. 10 through 12, a vertical mating connector 310 includes a dielectric housing 312, made of thermoplastic material or other suitable material, and a plurality of conductor pins or terminals 314. Terminals 314 may be made from any suitable conductive materials which have the appropriate electrical and mechanical properties required.

The housing 312 has top surface 320, a bottom wall 322, side walls 324, 326 which extend between the top surface 320 and the bottom wall 322 and end walls 328, 330 which extend between the side walls 324, 326.

In the embodiment shown, the housing 312 has one row of longitudinal terminal receiving recesses 332 which extend through the bottom wall 322 of the housing 312 toward the top surface 320. However, various numbers of rows and other configurations of the terminal receiving recesses 332 can be used without departing from the scope of the invention.

The housing 312 shown in FIGS. 10 through 12 is shown for illustrative purposes only. Many different housings can be used without departing from the scope of the invention. In addition, the connector 310 may be oriented horizontally or vertically, as known in the industry.

As best shown in FIG. 10, each terminal 314 has a connector securing section 342 provided to maintain the terminals 314 in the terminal receiving recesses 332 of the housing 312. The connector securing sections 342 can be of any type known in the industry, including, but not limited to, projections or barbs.

Substrate mating ends 344 of the terminals 314 extend from the connector securing sections 342 and from the housing 312. The mating ends 344 have substrate mating sections or portions 346, which may have, but are not limited to, compliant sections or barbs. The mating ends 344 are dimensioned to cooperate with openings 349 of a mating substrate 348. The opening 349 may be, but not limited to, through holes.

The substrate 348 has a predetermined pattern of openings 349 which receive the substrate mating portions 346 when the connector is fully mated to the substrate 348. The substrate 348 may be, but is not limited to, a printed circuit board which has conductors or circuit paths.

Stabilization members 350 are provide proximate the bottom wall 322 of the housing 312. As best viewed in FIGS. 11 and 12, the stabilization members 350 have a top wall 352, a bottom wall 354, a circular side wall 356 which extends between the top wall 352 and the bottom wall 354. In the initial or first position, as shown in FIG. 11, the sidewall 356 of each stabilization member 350 are integrally molded to a side wall 324, 326, an end wall 328, 330 or both. In this initial position, the stabilization members 350 extend from the bottom wall 322 a distance which is less than the distance that the mating ends 344 of the terminals 314 extend from the bottom wall 322.

The areas or portions 366 provided between the side walls 324, 326 or end walls 328, 330 and the side walls 356 are configured to be thin and/or weak. Consequently, an upward force (in a direction to the top surface 320) applied to the stabilization members 350 causes the weak portions 366 to fail or breakaway from the stabilization members 350. Once the weak portions 366 have failed, the continued application of the force causes the stabilization members 350 to move from the first position shown in FIG. 11, to the second position in which the stabilization members 350 are no longer attached to the housing 312, as shown in FIG. 12.

In use, the connector 310 is positioned on the substrate 348 in an initial position (FIG. 11). In this position, the tips of the mating ends 344 of the terminals 314 are positioned in the openings 349 of the substrate 348. However, the mating ends 344 are not fully seated or fully inserted into the openings 349. Consequently, without additional support, the connector 310 would not be stable on the substrate 348 as the assembly process continues. The stabilization members 350 are provided to cooperate with the substrate 348 to stabilize the connector 310 thereon. In the first position, the bottom walls 354 of the stabilization members 350 engage the substrate 348 to stabilize or balance the connector 310 on the substrate. The stabilization members 350 are provided on opposite ends of side walls 324, 326 of the connector 310. The stabilization members 350 extend so that portions of the stabilization members 350 are provided on opposite sides of the terminals 314 to provide proper support. As the stabilization members 350 are integrally molded to the housing 312, the stabilization members 350 remain in the first position until a force is applied thereto.

At the appropriate time, a force is applied to the housing 312 of the connector 310 to cause the bottom wall 322 of the housing 312 to move toward the substrate 348. As this occurs, the substrate 348 causes an upward force to be applied to the stabilization members 350, causing the weak portions 366 to fail or breakaway from the stabilization members 350. Once the weak portions 366 have failed, the continued application of the force causes the stabilization members 350 to move away from the housing 312, moving the stabilization members 350 from the first position shown in FIG. 11, to the second position shown in FIG. 12.

The force applied to the housing 312 is stopped when the mating portions 346 of mating ends 344 are fully seated in the openings 349 of the substrate 348.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector for mounting on a substrate, the connector comprising:

a housing having a top wall, a bottom wall, side walls extending between the top wall and the bottom wall, and end walls extending between the side walls, terminal receiving recesses extend through the bottom wall;

contacts positioned in the terminal receiving recesses, the contacts having securing sections for securing the contacts in the terminal receiving recesses and substrate mating sections which extend from the bottom wall of the housing in a direction away from the top wall; and at least one stabilization member, the at least one stabilization member extending from the bottom wall of the housing in a direction away from the top wall, the at least one stabilization member being movable between a first position and a second position, the at least one stabilization member engaging the substrate when the at least one stabilization member is in the first position to maintain the connector in a stable position relative to the substrate;

wherein the at least one stabilization member is connected to the bottom wall of the housing of the connector by portions which are configured to be weak, wherein when a force is applied to the at least one stabilization member in a direction toward the to wall, the weak portions will fail, allowing the at least one stabilization member to move to the second position to separate from the housing.

2. The connector as recited in claim 1, wherein the at least one stabilization member extends from the bottom wall of the housing a distance which is less than the distance that mating ends of the terminals extend from the bottom wall of the housing.

3. The connector as recited in claim 1, wherein the at least one stabilization member includes two stabilization members which are positioned on opposite corners of the housing of the connector, wherein the stabilization members are provided on opposite sides of the terminals to provide proper support.

4. The connector as recited in claim 1, wherein the at least one stabilization member includes two stabilization members which are positioned on opposite ends of the housing of connector, the stabilization members extend so that portions of the stabilization members are provided on opposite sides of the terminals to provide proper support.

5. The connector as recited in claim 1, wherein the at least one stabilization member is provided proximate the center of the housing of the connector.

6. The connector as recited in claim 1, wherein at least one stabilization member receiving slot extends from the bottom wall of the housing, the at least one stabilization member receiving slot dimensioned to receive the at least one stabilization member as the at least one stabilization member is moved toward the second position.

7. The connector as recited in claim 6, wherein at least one stabilization member has a stabilization member top wall, a stabilization member bottom wall, and stabilization member side walls which extend between the stabilization member top wall and the stabilization member bottom wall, the at least one stabilization member is integrally molded to walls of the at least one stabilization member receiving slot.

8. A connector for mounting on a substrate, the connector comprising:

a housing having a top wall, a bottom wall, side walls extending between the top wall and the bottom wall, and end walls extending between the side walls, terminal receiving recesses extend through the bottom wall;

contacts positioned in the terminal receiving recesses, the contacts having securing sections for securing the contacts in the terminal receiving recesses and substrate mating sections which extend from the bottom wall of the housing in a direction away from the top wall; at least one stabilization member, the at least one stabilization member extending from the bottom wall of the housing in a direction away from the top wall, the at least one stabilization member being movable between a first position and a second position, the at least one stabilization member engaging the substrate when the at least one stabilization member is in the first position to maintain the connector in a stable position relative to the substrate;

the at least one stabilization member is connected to the bottom wall of the housing of the connector by portions which are configured to be weak, wherein when a force is applied to the at least one stabilization member in a direction toward the top wall, the weak portions will fail, allowing the at least one stabilization member to move toward the second position to separate from the bottom wall of the housing.

9. The connector as recited in claim 8, wherein at least one stabilization member receiving slot extends from the bottom wall of the housing, the at least one stabilization member receiving slot dimensioned to receive the at least one stabilization member as the at least one stabilization member is moved toward the second position.

10. The connector as recited in claim 9, wherein at least one stabilization member has a stabilization member top wall, a stabilization member bottom wall, and stabilization member side walls which extend between the stabilization member top wall and the stabilization member bottom wall, the weak portions of the at least one stabilization member are integrally molded to walls of the at least one stabilization member receiving slot.

11. The connector as recited in claim 10, wherein the at least one stabilization member extends from the bottom wall of the housing a distance which is less than the distance that mating ends of the terminals extend from the bottom wall of the housing.

12. The connector as recited in claim 11, wherein the at least one stabilization member includes two stabilization members which are positioned on opposite corners of the housing of the connector, wherein the stabilization members are provided on opposite sides of the terminals to provide proper support.

13. The connector as recited in claim 11, wherein the at least one stabilization member includes two stabilization members which are positioned on opposite ends of the housing of connector, the stabilization members extend so that portions of the stabilization members are provided on opposite sides of the terminals to provide proper support.

14. The connector as recited in claim 11, wherein the at least one stabilization member is provided proximate the center of the housing of the connector.

15. A method of inserting a connector onto a substrate, the method comprising:

aligning mating ends of terminals of a connector with openings the substrate;

positioning connector on substrate in a first position, wherein tips of the mating ends of the connector are positioned in the openings and at least one bottom wall of at least one stabilization member is in engagement with the substrate;

maintaining the connector in the first position by the cooperation of at least one bottom wall of at least one stabilization member with the substrate;

exerting a force on the housing of the connector to move the housing toward the substrate; and moving the at least one stabilization member from a first position in which the at least one stabilization member extends from a bottom wall of the connector to a second position in which the at least one stabilization member is retained in a slot with the housing of the connector.

16. The method as recited in claim 15, wherein the at least one stabilization member includes two stabilization members which are positioned on opposite corners of the housing of the connector, wherein the stabilization members are provided on opposite sides of the terminals to provide proper support.

17. The method as recited in claim 15, wherein the at least one stabilization member includes two stabilization members which are positioned on opposite ends of the housing of connector, the stabilization members extend so that portions of the stabilization members are provided on opposite sides of the terminals to provide proper support.

18. The method as recited in claim 15, wherein the at least one stabilization member is provided proximate the center of the housing of the connector.

* * * * *